US010999662B2

(12) United States Patent
Morisaki et al.

(10) Patent No.: US 10,999,662 B2
(45) Date of Patent: May 4, 2021

(54) SPEAKER DEVICE

(71) Applicants: Onkyo Corporation, Osaka (JP); DENSO TEN Limited, Hyogo (JP)

(72) Inventors: Masahiro Morisaki, Hyogo (JP); Kazuhiko Hamada, Hyogo (JP)

(73) Assignees: Onkyo Corporation, Osaka (JP); DENSO TEN Limited, Hyogo (JP)

( * ) Notice: Subject to any disclaimer, the term of this patent is extended or adjusted under 35 U.S.C. 154(b) by 0 days.

(21) Appl. No.: 16/201,154

(22) Filed: Nov. 27, 2018

(65) Prior Publication Data

US 2019/0215588 A1 Jul. 11, 2019

(30) Foreign Application Priority Data

Jan. 10, 2018 (JP) ..... JP2018-002136

(51) Int. Cl.
*H04R 1/02* (2006.01)
*H04R 9/02* (2006.01)
*H04R 9/06* (2006.01)

(52) U.S. Cl.
CPC ..... *H04R 1/025* (2013.01); *H04R 9/025* (2013.01); *H04R 9/06* (2013.01)

(58) Field of Classification Search
CPC ..... H04R 1/025; H04R 9/025; H04R 9/06
See application file for complete search history.

(56) References Cited

U.S. PATENT DOCUMENTS

2001/0028724 A1 10/2001 Kowaki
2002/0114485 A1* 8/2002 Ohira ..... H04R 1/026 381/386
2006/0153413 A1 7/2006 Nakajima
2006/0280321 A1* 12/2006 Miura ..... H04R 1/2873 381/186

FOREIGN PATENT DOCUMENTS

| | | | |
|---|---|---|---|
| JP | S62-19896 | U | 2/1987 |
| JP | 3778793 | B | 5/2006 |
| JP | 3894492 | B | 3/2007 |
| JP | 2009-016946 | A | 1/2009 |
| JP | 2009-044244 | A | 2/2009 |

* cited by examiner

*Primary Examiner* — Ping Lee
(74) *Attorney, Agent, or Firm* — Renner, Otto, Boisselle & Sklar, LLP

(57) ABSTRACT

A speaker device includes: a speaker unit that includes an acoustic radiation portion; a first box section configured to contain the inserted speaker unit in the box; a support member that pushes the speaker unit against a back wall in the first box section, thereby supporting the speaker unit; a flexible front cushion compressed and contacted between the speaker unit and the support member; and a flexible rear cushion compressed and contacted between the speaker unit and the back wall in the first box section. The speaker unit is pushed and supported by the support member and the back wall of the first box section through the front cushion and the rear cushion.

5 Claims, 7 Drawing Sheets

SPEAKER DEVICE

CROSS REFERENCE TO RELATED APPLICATION

The disclosure of Japanese Patent Application No. 2018-002136 filed on Jan. 10, 2018 including the specification, claims, drawings, and abstract is incorporated herein by reference in its entirety.

TECHNICAL FIELD

The present invention relates to a speaker device containing a speaker unit in a speaker box.

BACKGROUND

To give a conventional example, JP 3894492 B discloses a speaker device in which a speaker unit is contained in a speaker box having an opening, a speaker is supported in a space in the speaker box, and an acoustic radiation portion of the speaker unit is connected to the opening of the speaker box. In this speaker device, the main body of a weight having such a mass that it can act as the virtual ground for acoustic vibration is coupled to the back surface of the driver for the speaker unit by means of a bolt, and the ends of multiple supports which radially extend from the main body of this weight are fixed by means of bolts from the outside of the box.

According to the above-mentioned disclosure, with this configuration, the weight coupled to the speaker unit has such a mass that it can act as the virtual ground for acoustic vibration, so that the acoustic radiation portion of the speaker unit has an acoustic impedance sufficiently higher than that of the air through which the acoustic output propagates and the speaker unit hardly vibrates even upon reception of a reaction force resulting from the emission of the acoustic output to the air.

SUMMARY

Technical Problem

The speaker device disclosed in JP 3894492 B has four bolts for fixing the speaker unit in the speaker box, which complicates the process of assembly of the speaker device.

It is an advantage of the present invention to provide a speaker device for which the speaker unit is easily assembled to the speaker box while the vibration barely propagates from the speaker unit to the speaker box.

Solution to Problem

A speaker device according to the present invention includes: a speaker unit that includes an acoustic radiation portion; a speaker box that has an opening and is configured to contain the speaker unit inserted from the opening; a support member that is attached to the opening of the speaker box and pushes the speaker unit against a back wall in the speaker box, thereby supporting the speaker unit; a flexible front cushion compressed and contacted between the speaker unit and the support member; and a flexible rear cushion compressed and contacted between the speaker unit and the back wall in the speaker box. The speaker unit is pushed and supported by the support member and the back wall of the speaker box through the front cushion and the rear cushion.

With this configuration, the speaker unit is pushed and supported by the support member and the back wall of the speaker box through the front and rear cushions, so that the vibration from the speaker unit barely propagates to the speaker box. Consequently, the sound quality of the acoustic output from the speaker unit is prevented from deteriorating due to the acoustic output produced by the vibration of the speaker box.

In addition, since the speaker unit is pushed and supported by the support member and the back wall of the speaker box, the speaker unit can be assembled by merely attaching the support member to the opening of the speaker box through a bayonet structure; thus, the process of the assembly of the speaker device is facilitated.

In the speaker device according to the present invention, it is preferable that the front cushion has such flexibility that the front cushion can be deformed more easily than the rear cushion. In this case, the front cushion may be composed of elastic sponge, and the rear cushion may be composed of felt.

With this configuration, the vibration of the acoustic radiation portion located at the front end of the speaker unit can be effectively absorbed by the front cushion, so that the propagation of the vibration from the speaker unit to the speaker box can be more effectively suppressed.

Further, in the speaker device according to the present invention, the support member includes multiple claw portions, the support member is configured to be temporarily assembled to the speaker unit when the multiple claw portions are engaged with a flange portion located at a front end of the speaker unit, and the claw portions are not in contact with the speaker unit when the support member temporarily assembled to the speaker unit is attached to the speaker box.

With this configuration, the support member can be attached to the speaker box while the support member is temporarily assembled to the speaker unit; thus, the process of assembly of the speaker device can be facilitated. Moreover, the claw portions are not in contact with the speaker unit when the support member is attached to the speaker box; thus, the propagation of the vibration from the speaker unit to the speaker box can be more effectively suppressed.

Furthermore, in the speaker device according to the present invention, it is preferable that the support member includes multiple engagement hooks, multiple engagement projections are formed on an inner surface of the speaker box at intervals along a circumferential direction, and the support member is attached to the speaker box when the multiple engagement hooks are inserted between the multiple engagement projections and the support member is rotated with respect to the speaker box so that the engagement hooks are engaged with back surfaces of the engagement projections.

With this configuration, the support member can be attached to the speaker box through a so-called bayonet structure. Accordingly, the speaker unit can be assembled without fastening a bolt, which facilitates the process of assembly of the speaker device.

Advantageous Effects of Invention

For a speaker unit according to the present invention, the speaker unit is easily assembled to the speaker box while the vibration barely propagates from the speaker unit to the speaker box.

BRIEF DESCRIPTION OF DRAWINGS

Embodiments of the present disclosure will be described by reference to the following figures, wherein.

DESCRIPTION OF EMBODIMENTS

Embodiments of the present invention will now be described in detail with reference to the accompanying drawings. In this description, specific shapes, materials, numerical values, directions, and the like are illustrations for easy understanding and supporting of the present invention, and can be changed as appropriate in accordance with the intended use, purpose, specifications, and the like. Moreover, when multiple embodiments, modifications, and the like are included below, appropriate combination of their characteristics is assumed.

Figure 1A:
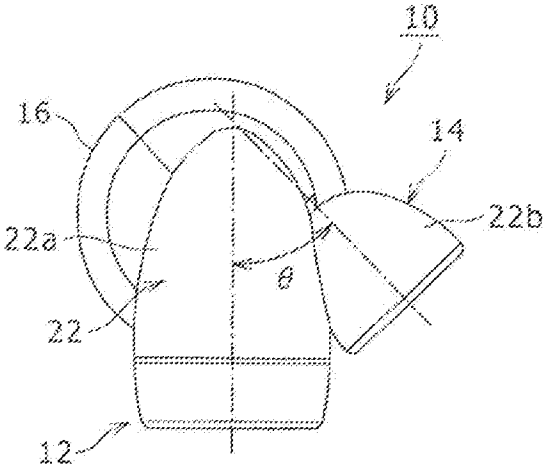
FIG. 1A is a plan view of a speaker device which is one embodiment of the present invention.
Figure 1B:
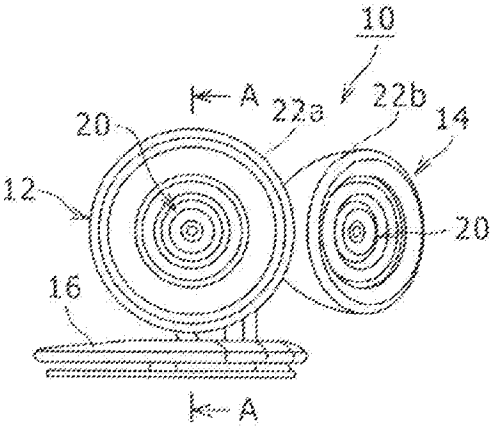
FIG. 1B is a front view of the speaker device shown in FIG. 1A.
Figure 1C:
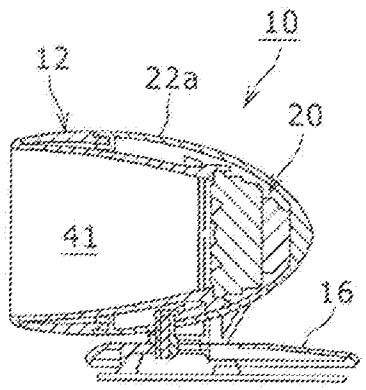
FIG. 1C is a cross-sectional view of the speaker device shown in FIG. 1B along line A-A.
Figure 1D:
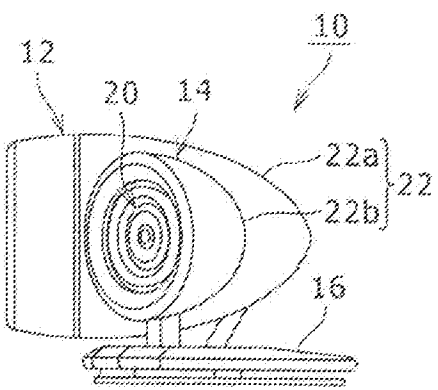
FIG. 1D is a side view of the speaker device.
Figure 2:
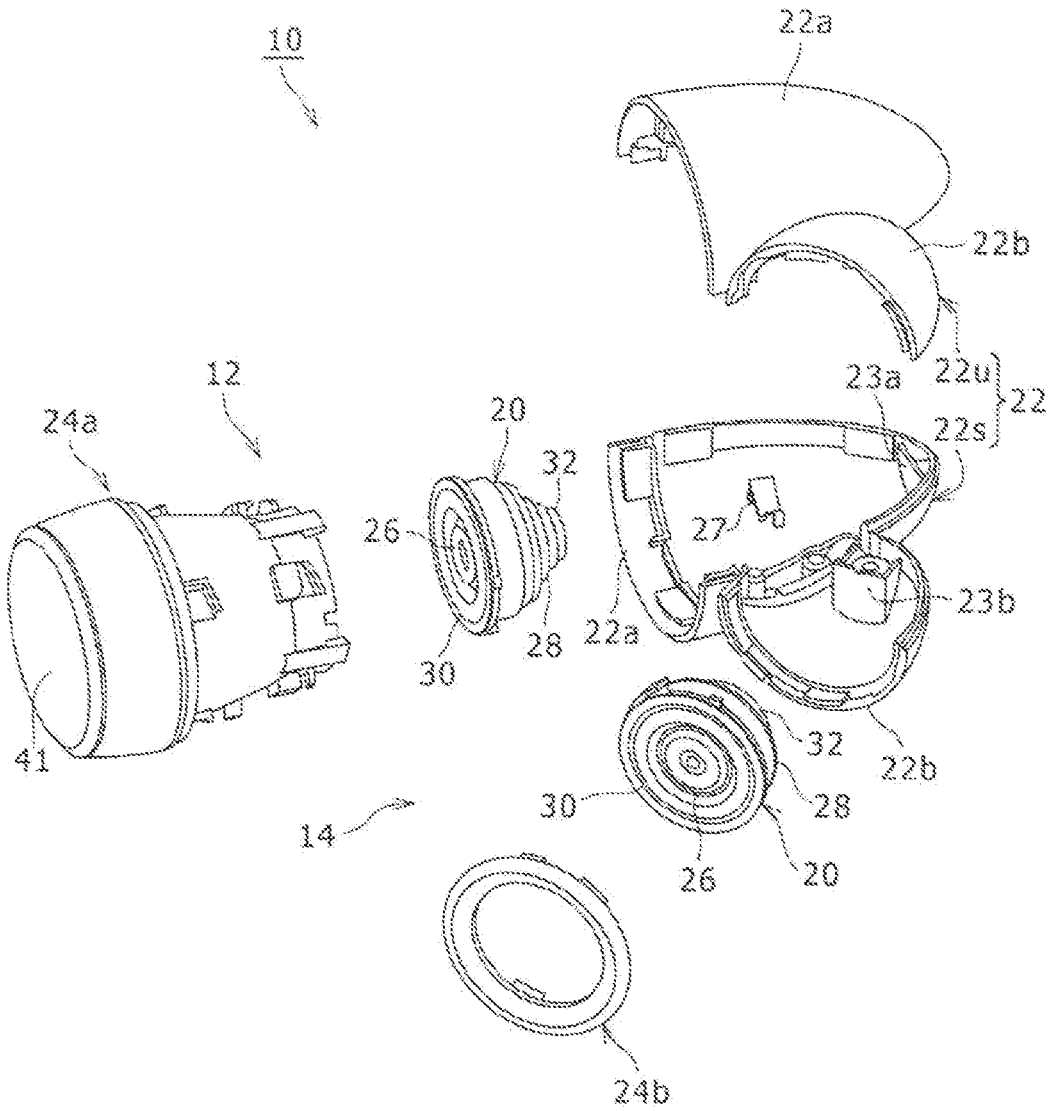
FIG. 2 is an exploded perspective view of the speaker device shown in FIG. 1.

FIG. 1A is a plan view of a speaker device 10 which is one embodiment of the present invention, FIG. 1B is a front view of the speaker device shown in FIG. 1A, FIG. 1C is a cross-sectional view of FIG. 1B along line A-A, and FIG. 1D is a side view of the speaker device shown in FIG. 1A. FIG. 2 is an exploded perspective view of the speaker device 10 shown in FIG. 1. In the description below, for each of the first speaker section and the second speaker section, the side of the free space toward which the acoustic output is emitted from the speaker unit is "front," and the opposite side is "back."

As shown in FIGS. 1A to 1D, the speaker device 10 includes a first speaker section 12 and a second speaker section 14 which are integrated into one piece. In this embodiment, the angle θ between the direction of the acoustic output of the first speaker section 12 and the direction of the acoustic output of the second speaker section 14 is set, for example, to 45°.

Further, the speaker device 10 may include a standing support 16. The standing support 16 is attached to the bottom of the speaker device 10 including the first and second speaker sections 12 and 14 through fastener means, such as a screw, for example. With such a standing support 16, the speaker device 10 can be placed on an installation surface. The standing support 16 may be fixed to a placement surface using, for example, double-faced tape.

The first speaker section 12 and the second speaker section 14 each include a speaker unit 20. The speaker unit 20 in the first speaker section 12 and the speaker unit 20 in the second speaker section 14 may have the same configuration. As shown in FIG. 1C, in the first speaker section 12, the speaker unit 20 is contained in the deep recess of the speaker box. In contrast, in the second speaker section 14, as shown in FIGS. 1B and 1D, the speaker unit 20 is contained so that it is exposed from the opening of the speaker box.

As shown in FIGS. 1A to 1D, the speaker device 10 includes a speaker box 22. The speaker box 22 includes a first box section 22*a* constituting the first speaker section 12, and a second box section 22*b* constituting the second speaker section 14, which are integrated into one piece. The contour of the first box section 22*a* has, for example, a cannon ball shape or an acorn shape that has a circular open front end and has a diameter gradually decreasing toward the rear end. The contour of the second box section 22*b* also has, for example, a cannon ball shape or an acorn shape that has a circular open front end and has a diameter gradually decreasing toward the rear end, but has a shorter front-rear length than the first box section 22*a*.

Moreover, as shown in FIG. 2, the speaker box 22 consists of two separate parts: an upper box section 22*u* and a lower box section 22*s*. The upper box section 22*u* and the lower box section 22*s* are preferably formed by, for example, resin molding.

As shown in FIG. 2, the first speaker section 12 of the speaker device 10 consists of the first box section 22*a*, the speaker unit 20, and a first support member 24*a*. The second speaker section 14 of the speaker device 10 consists of the second box section 22*b*, the speaker unit 20, and a second support member 24*b*. Since the speaker units 20 included in the first and second speaker sections 12 and 14 have the same configuration as described above, the first speaker section 12 and second speaker section 14 are not distinguished from each other in the description below.

The speaker unit 20 has a diaphragm 26, which serves as an acoustic radiation portion, at the front end, and a driver 28, which vibrates the diaphragm 26, at the rear end. The driver 28 includes a magnetic circuit, a voice coil, and the like which are not shown in the drawing.

Moreover, a front cushion 30 is provided on the outer surface of the front end of the speaker unit 20. The front cushion 30 has an annular shape and is composed of a flexible material. To be specific, the front cushion 30 is preferably composed of, for example, elastic sponge. In particular, the front cushion 30 is composed of, for example, urethane sponge. The front cushion 30 is fixed to the front side of the frame to which the outer surface of the diaphragm 26 is fixed, for example, through adhesion. Moreover, the front cushion 30 preferably has such flexibility that it can be deformed more easily than can a rear cushion 32 which will be described later.

On the other hand, the rear cushion 32 is provided at the rear end of the speaker unit 20. The rear cushion 32 is a flat cylinder composed of a flexible material. In particular, the rear cushion 32 is preferably composed of, for example, felt, particularly wool felt.

The first support member 24*a* of the first speaker section 12 is a member that is attached to the opening of the first box section 22*a* and pushes and supports the speaker unit 20 with a back wall 23*a* in the first box section 22*a*. Further, the second support member 24*b* of the second speaker section 14 is a member that is attached to the opening of the second box section 22*b* and pushes and supports the speaker unit 20 with a back wall 23*b* in the second box section 22*b*.

Figure 3:
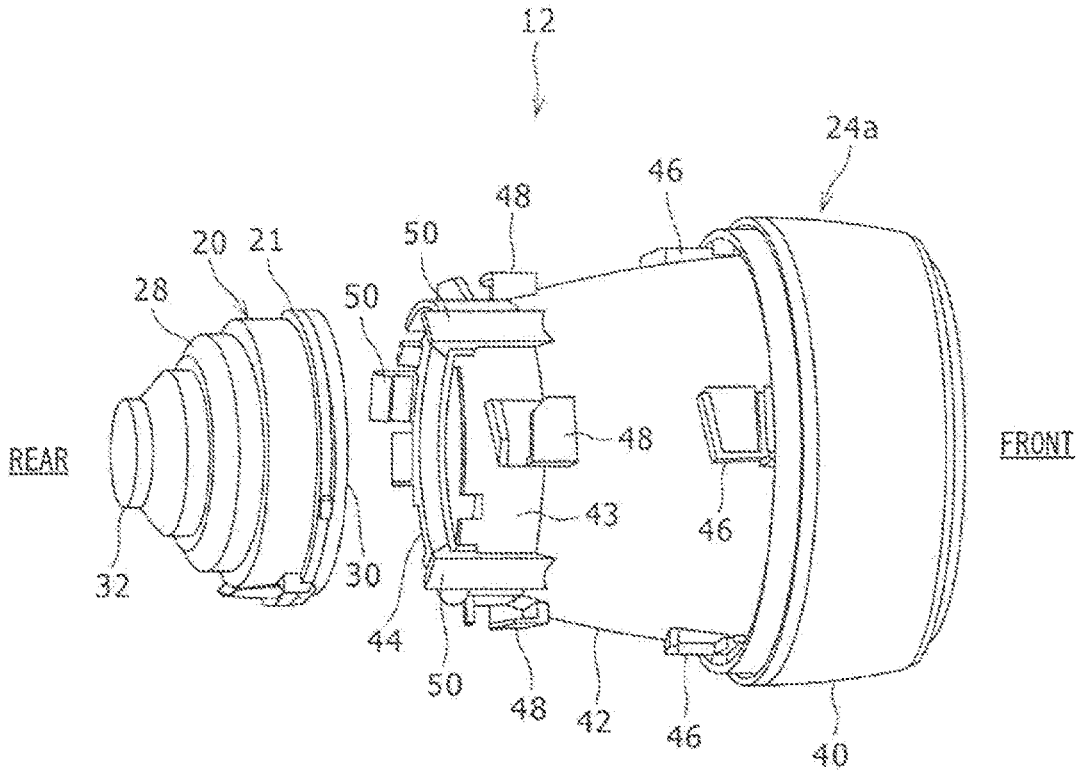
FIG. 3 is a perspective view showing a speaker unit and a first support member which constitute a first speaker section, in the exploded state.
Figure 4:
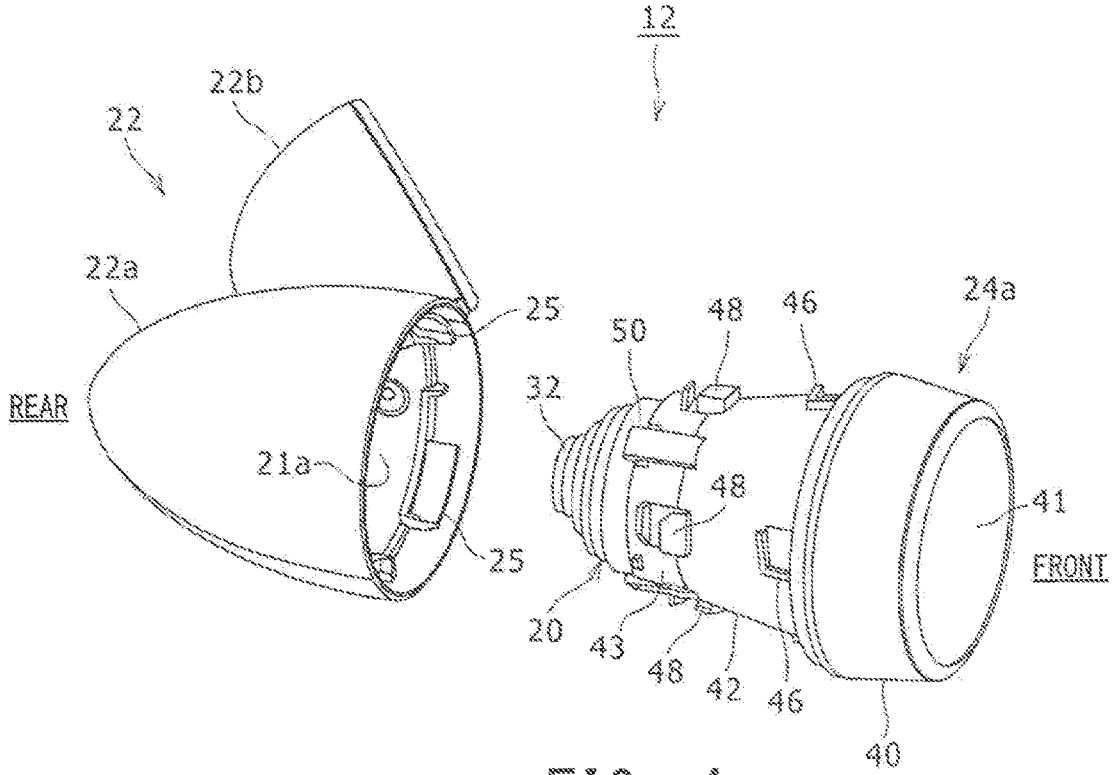
FIG. 4 is a perspective view showing the temporarily assembled speaker unit and the first support member and speaker box, in the exploded state.

The first speaker section 12 will now be further described with reference to FIGS. 3 to 7. FIG. 3 is a perspective view showing the speaker unit 20 and the first support member 24*a* which constitute the first speaker section 12, in the exploded state. FIG. 4 is a perspective view showing the temporarily assembled speaker unit 20 and the first support member 24*a* and speaker box 22, in the exploded state.

As shown in FIG. 3, the first support member 24*a* is a generally cylindrical member including a front end portion 40, a middle portion 42, and a rear end portion 43. The first support member 24*a* is integrally formed by, for example, resin molding.

The first support member 24*a* has an internal space 41 which is a through hole extending in the front-rear direction and whose diameter gradually increases toward the front side. This internal space 41 is exposed from the front end portion 40 and rear end portion 43 of the first support member 24*a*. Moreover, this internal space 41 has a function of imparting directivity to the acoustic output from the speaker unit 20 attached to the rear end portion 43 of the first support member 24*a*. In other words, the acoustic output from the speaker unit 20 is emitted toward the front side toward which the internal space 41 of the first support member 24*a* extends.

In the first support member 24*a*, the front end portion 40 has substantially the same diameter as the front end portion of the first box section 22*a* of the speaker box 22. Thus, when the first support member 24*a* is assembled to the first box section 22*a*, the first support member 24*a*, the front end portion 40, and the first box section 22*a* constitute a continuous outer surface without a level difference.

The middle portion 42 of the first support member 24*a* has a flared shape whose outer diameter gradually increases toward the front side. Multiple engagement hooks 46 and 48 are formed on the outer surface of the middle portion 42. To be specific, the front outer surface of the middle portion 42 near the front end portion 40 is provided with four front engagement hooks 46 aligned at equal intervals (every 90 degrees) in the circumferential direction.

Meanwhile, the rear outer surface of the middle portion 42 near the rear end portion 43 is provided with four rear engagement hooks 48 aligned at regular intervals (every 90 degrees) in the circumferential direction. The front engagement hooks 46 and the rear engagement hooks 48 are disposed at the same angular positions in the circumferential direction so that they are aligned to each other when the first support member 24*a* is seen from the front.

Figure 5A:
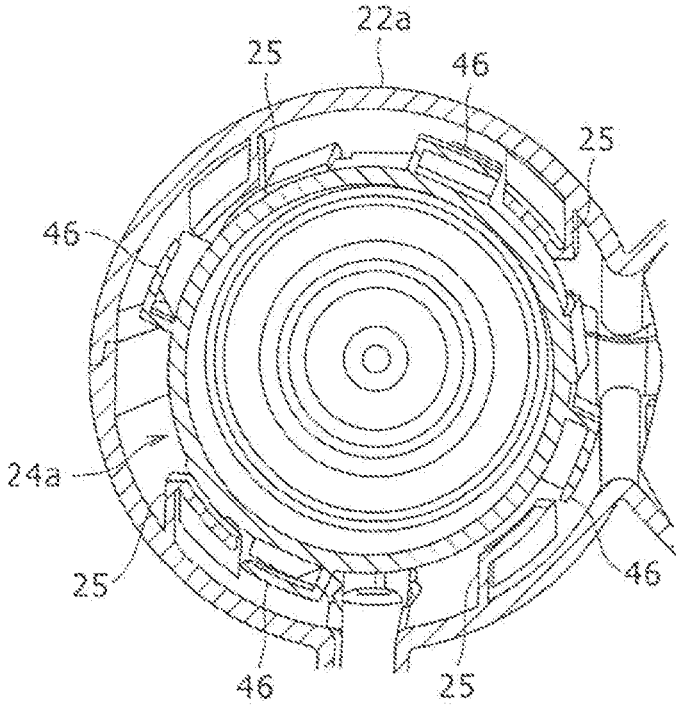
FIG. 5A is a front view showing the state before the engagement hooks of the first support member are engaged with the engagement projections on the inner surface of the speaker box.

The front engagement hooks 46 of the first support member 24*a* have an L cross-sectional shape and protrude from the outer surface of the middle portion 42, thereby forming hooks opened toward one side along the circumferential direction (see FIG. 5A). Note that the rear engagement hooks 48 have substantially the same shape as the front engagement hooks 46.

As shown in FIG. 3, in the middle portion 42 of the first support member 24*a*, the outer surface near the rear end portion 43 is provided with multiple claw portions 50. In this embodiment, three claw portions 50 are disposed at regular intervals (every 120 degrees) along the circumferential direction and between the rear engagement hooks 48. The claw portions 50 each include a leg portion extending from the outer surface of the middle portion 42 toward the rear, a step portion protruding from the inner surface of the leg portion inward along the radial direction, and a slope that is continuous from the step portion and expands radially outward toward the rear. In addition, the rear end portions of the claw portions 50 protrude further than the rear end portion 43 of the first support member 24*a*, and the step portions of the claw portions 50 are located behind the rear end 44 of the rear end portion 43.

The first support member 24*a* having such a configuration is temporarily assembled to the speaker unit 20. To be specific, the speaker unit 20 is temporarily assembled to the rear end portion 43 of the first support member 24*a* through the multiple claw portions 50.

When the rear end portion 43 of the first support member 24*a* is brought close to the front cushion 30 and a flange portion 21 at the front end of the speaker unit 20, the slope of each claw portion 50 comes in contact with the front cushion 30 and the flange portion 21, so that the claw portions 50 are pushed outward in the radial direction and displaced. After passing through the flange portion 21 of the speaker unit 20, the step portions of the claw portions 50 are displaced radially inward due to the elasticity of the claw portions 50. Consequently, the step portions of the claw portions 50 are engaged with the rear surface of the flange portion 21. Thus, the first support member 24*a* is temporarily assembled so that it cannot be detached from the speaker unit 20.

Note that this temporal assembly is made with such looseness that the speaker unit 20 cannot be detached unless radially outward external force is applied to the claw portions 50; thus, the rear end 44 of the first support member 24*a* is not compressed or deformed even when coming in contact with the front cushion 30 of the speaker unit 20.

The speaker unit 20 temporarily assembled to the first support member 24 in this manner is inserted to and contained in the first box section 22*a* of the speaker box 22 from the opening 21*a* as shown in FIG. 4. Multiple front engagement projections 25 are formed on the inner wall near the opening 21*a* of the first box section 22*a* at intervals along the circumferential direction. In this embodiment, four front engagement projections 25 corresponding to the front engagement hooks 46 of the first support member 24*a* are provided at regular intervals (every 90 degrees) along the circumferential direction.

Figure 6:
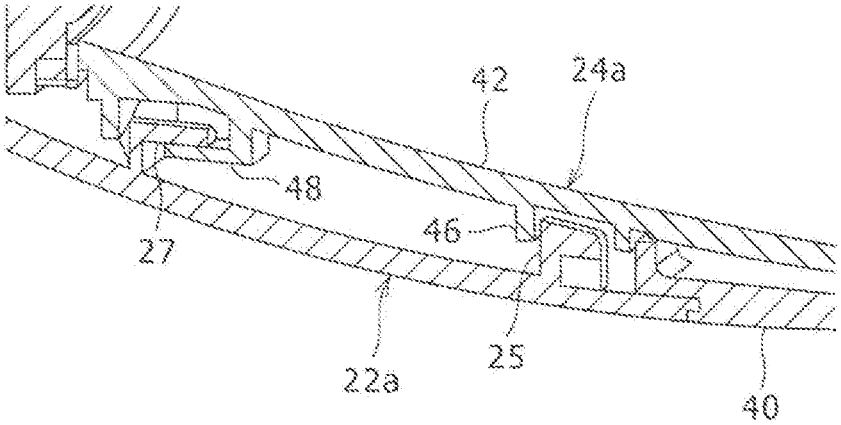
FIG. 6 is a partial cross-sectional view showing the state where the front and rear engagement hooks of the first support member are engaged with the front and rear engagement projections on the inner surface of the first box section, respectively.

Multiple rear engagement projections 27 are formed on the inner wall of the deep recess of the first box section 22*a* at intervals along the circumferential direction (see FIG. 6). In this embodiment, four rear engagement projections 27 corresponding to the rear engagement hooks 48 of the first support member 24*a* are provided at regular intervals (every 90 degrees) along the circumferential direction.

As shown in FIG. 5A, the front engagement projections 25 formed in the first box section 22*a* have an L cross-sectional shape, and are opened along the circumferential direction toward the side opposite to the side toward which the front engagement hooks 46 of the first support member 24*a* are opened. The same applies to the rear engagement projections 27 of the first support member 24*a*.

The speaker unit 20 temporarily assembled to the rear end portion 43 of the first support member 24*a* is inserted into the box from the opening 21*a* of the first box section 22*a* provided with such engagement projections 25 and 27. At this time, as shown in FIG. 5A, the multiple front engagement hooks 46 formed in the first support member 24*a* are inserted between the multiple engagement projections 25 formed on the inner wall of the first box section 22*a*. Further, although not shown in the drawing, the multiple engagement hooks 48 formed in the first support member 24*a* are inserted between the multiple rear engagement projections 27 formed on the inner wall of the first box section 22*a*. In addition, at this time, the front end portion 40 of the first support member 24*a* is in contact with the edge of the opening 21*a* of the first box section 22*a*.

Figure 5B:
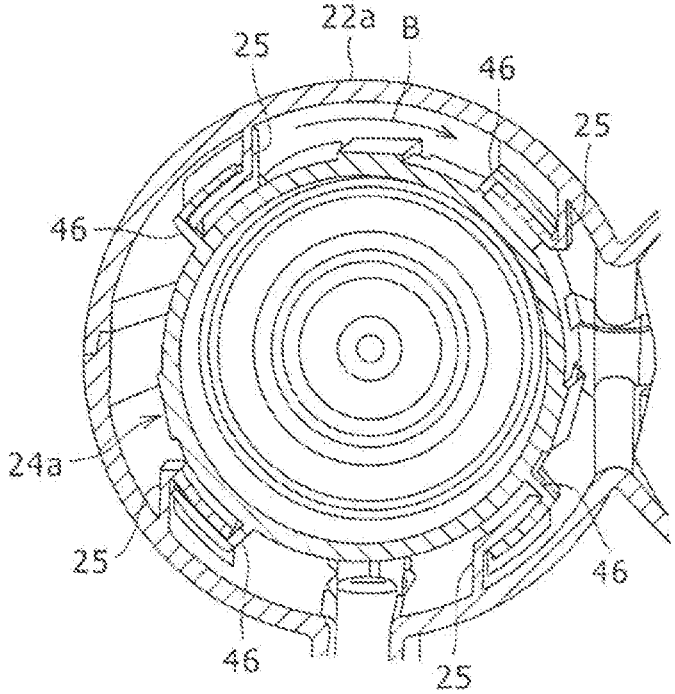
FIG. 5B is a front view showing the state where the engagement hooks of the first support member are engaged with the engagement projections on the inner surface of the speaker box.

In this state, as shown in FIG. 5B, the first support member 24*a* is rotated in the direction indicated by the arrow B. Accordingly, the front engagement hooks 46 of the first support member 24*a* are fit in and engaged with the front engagement projections 25 of the first box section 22*a*. Moreover, as shown in FIG. 6, the rear engagement hooks 48 of the first support member 24*a* are fit in and engaged with the rear engagement projections 27 of the first box section 22*a*. Consequently, the first support member 24*a* and the speaker unit 20 are attached while the movement of the first box section 22*a* in the front-rear direction is limited.

Further, at this time, regarding the first support member 24*a* and the speaker unit 20, since the engagement hooks 46 and 48 are in contact with the engagement projections 25 and 27 along the circumferential direction, the rotational position of the first support member 24*a* with respect to the first box section 22*a* along the circumferential direction is determined. Moreover, in this state, since the engagement hooks 46 and 48 are engaged with the engagement projections 25 and 27, the state where the upper box section 22*u* and the lower box section 22*s* (see FIG. 2) constituting the first box section 22*a* are coupled to each other is maintained.

It is preferable that the first support member 24*a* is fixed to the first box section 22*a* by using at least one screw, not shown in the drawing, so that the first support member 24*a* attached to the first box section 22*a* in this manner cannot be rotated in the opposite direction and become detached.

Figure 7:
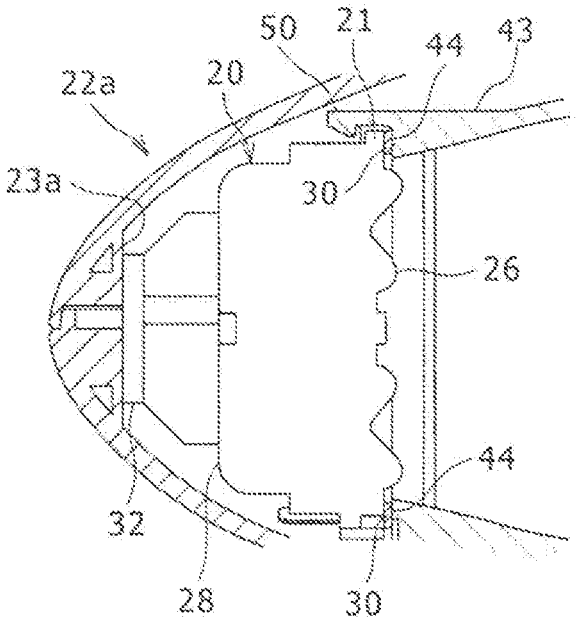
FIG. 7 is a partial cross-sectional view showing a relationship between the speaker unit and the claw portions of the first support member in the state where the first support member is attached to the first box section.

When the first support member 24*a* is attached to the first box section 22*a* in this manner, the speaker unit 20 contained in the first box section 22*a* is in the state shown in FIG. 7. In other words, the front cushion 30 provided on the front-end outer surface of the speaker unit 20 is compressed and contacted with the flange portion 21 and the rear end 44 of the first support member 24*a*. Further, the rear cushion 32 provided at the rear end of the speaker unit 20 is compressed and contacted with the speaker unit 20 and the back wall 23*a* of the first box section 22*a*. Accordingly, the speaker unit 20 is pushed and supported by the first support member 24*a* and the back wall 23*a* of the first box section 22*a* through the front cushion 30 and the rear cushion 32 which are flexible. In other words, the speaker unit 20 is supported without a direct contact with the first box section 22*a*. Consequently, the vibration of the speaker unit 20 during acoustic output barely propagates to the speaker box 22. Accordingly, the sound quality of the acoustic output from the speaker unit 20 is prevented from deteriorating due to the acoustic output produced by the vibration of the speaker box 22.

At this time, the cushions 30 and 32 (particularly the front cushion 30) are compressed and deformed, so that the claw portions 50 for temporally assembling the speaker unit 20 to the first support member 24*a* are separated from and not in contact with the flange portion 21 of the speaker unit 20. Thus, propagation of the vibration of the speaker unit 20 during acoustic output to the speaker box 22 through the first support member 24*a* is suppressed. This also prevents the sound quality of the acoustic output from the speaker unit 20 from deteriorating due to the acoustic output produced by the vibration of the speaker box 22.

Figure 8:
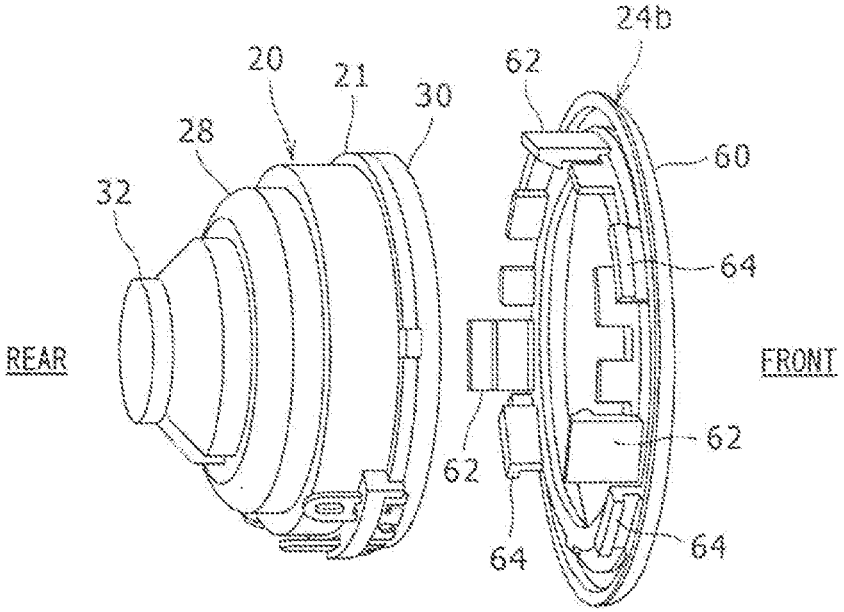
FIG. 8 is a perspective view showing the speaker unit and the second support member which constitute the second speaker section, in the exploded state.
Figure 9:
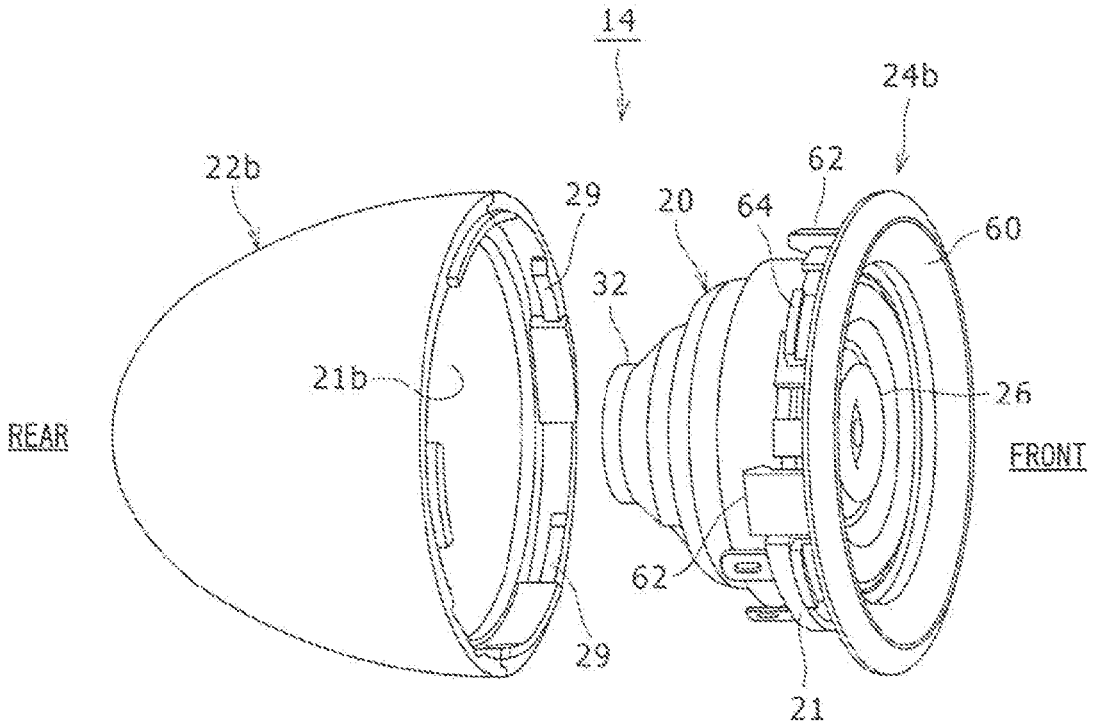
FIG. 9 is a perspective view showing the temporarily assembled speaker unit and the second support member and second box section, in the exploded state.
Figure 10:
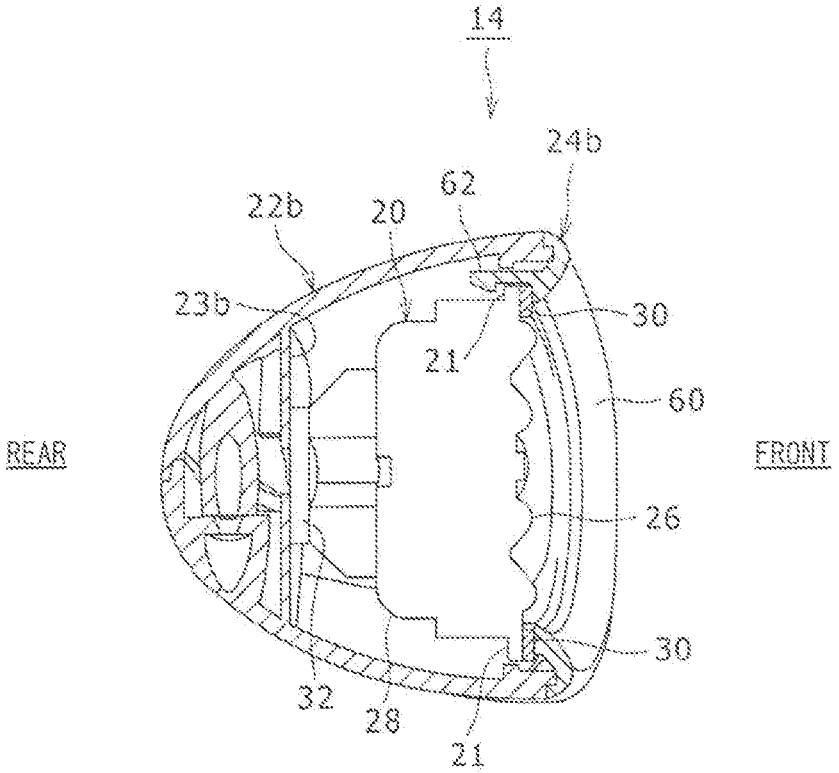
FIG. 10 is a cross-sectional view showing the state where the temporarily assembled speaker unit and the second support member are attached to the second box section.

The second speaker section 14 will now be described in detail with reference to FIGS. 8 to 10. FIG. 8 is a perspective view showing the speaker unit 20 and the second support member 24*b* which constitute the second speaker section 14, in the exploded state. FIG. 9 is a perspective view showing the temporarily assembled speaker unit 20 and the second support member 24*b* and second box section 22*b*, in the exploded state. FIG. 10 is a cross-sectional view showing the state where the temporarily assembled speaker unit 20 and the second support member 24*b* are attached to the second box section 22*b*. In the description below, the description of configurations and functions similar to those of the first speaker section 12 will be omitted as appropriate in some cases.

The second support member 24*b* is an annular member including an annular portion 60 and claw portions 62 and engagement hooks 64, which protrude toward the rear, on the annular portion 60. The second support member 24*b* is integrally formed by, for example, resin molding. Note that the claw portions 62 and engagement hooks 64 of the second support member 24*b* correspond to the claw portions 50 and front engagement hooks 46 of the first support member 24*a*.

As shown in FIG. 9, multiple engagement projections 29 are formed on the inner wall near the opening 21*b* of the second box section 22*b*. The engagement projections 29 constitute a so-called bayonet structure together with the engagement hooks 64 of the second support member 24*b*. In this embodiment, the engagement projections 29 have rib shapes extending in the circumferential direction. Note that the engagement projections 29 of the second box section 22*b* correspond to the front engagement projections 25 of the first box section 22*a*.

As shown in FIG. 8, the second support member 24*b* is temporarily assembled by engagement of the claw portions 62 with the flange portion 21 at the front end of the speaker unit 20. The speaker unit 20 temporarily assembled to the second support member 24*b* in this manner is inserted from the opening 21*b* of the second box section 22*b* and contained in the box as shown in FIG. 9.

When the speaker unit 20 is inserted to the second box section 22*b*, the engagement hooks 64 of the second support member 24*b* are inserted between the engagement projections 29 of the second box section 22*b*. Subsequently, in the state in which the annular portion 60 of the second support member 24*b* is in contact with the edge of the opening 21*b* of the second box section 22*b*, the second support member 24*b* is rotated with respect to the second box section 22*b*. Thus, the engagement hooks 64 of the second support member 24*b* engage with the rear surfaces of the engagement projections 29 of the second box section 22*b*, and the movement of the second support member 24*b* and the speaker unit 20 in the front-rear direction is limited. Further, since the engagement hooks 64 are in contact with the walls of the engagement projections 29 which intersect the circumferential direction, the rotational positions of the second support member 24*b* and the speaker unit 20 with respect to the second box section 22*b* along the circumferential direction are determined. It is preferable that the second support member 24*b* is fixed to the second box section 22*b* by using at least one screw not shown in the drawing so that the second support member 24*b* attached to the second box section 22*b* in this manner cannot be rotated in the opposite direction and become detached.

When the second support member 24*b* is attached to the second box section 22*b* in this manner, the speaker unit 20 contained in the second box section 22*b* is in the state shown in FIG. 9. In other words, the front cushion 30 provided on the front-end outer surface of the speaker unit 20 is compressed and contacted with the flange portion 21 and the annular portion 60 of the second support member 24*b*.

Further, the rear cushion 32 provided at the rear end of the speaker unit 20 is compressed and contacted with the speaker unit 20 and the back wall 23*b* of the second box section 22*b*. Accordingly, the speaker unit 20 is pushed and supported by the second support member 24*b* and the back wall 23*b* of the second box section 22*b* through the front cushion 30 and the rear cushion 32 which are flexible. In other words, the speaker unit 20 is supported without direct contact with the second box section 22*b*. Consequently, the vibration of the speaker unit 20 during acoustic output barely propagates to the speaker box 22. Accordingly, the sound quality of the acoustic output from the speaker unit 20 is prevented from decreasing due to the acoustic output produced by the vibration of the speaker box 22.

At this time, the cushions 30 and 32 (particularly the front cushion 30) are compressed and deformed, so that the claw portions 62 for temporarily assembling the speaker unit 20 to the second support member 24*b* are separated from and not in contact with the flange portion 21 of the speaker unit 20. Thus, propagation of the vibration of the speaker unit 20 during acoustic output to the speaker box 22 through the second support member 24*b* is suppressed. This also prevents the sound quality of the acoustic output from the speaker unit 20 from deteriorating due to the acoustic output produced by the vibration of the speaker box 22.

As described above, in the speaker device 10 of this embodiment, the speaker unit 20 is pushed and supported by the first and second support members 24*a* and 24*b* and the back walls 23*a* and 23*b* of the speaker box 22 through the front and rear cushions 30 and 32, so that the vibration of the speaker unit 20 barely propagates to the speaker box 22. Consequently, the sound quality of the acoustic output from the speaker unit 20 is prevented from deteriorating due to the acoustic output produced by the vibration of the speaker box 22.

In addition, since the speaker unit 20 is pushed and supported by the first and second support members 24*a* and 24*b* and the back walls 23*a* and 23*b* of the speaker box 22, the speaker unit 20 can be assembled by merely attaching the first and second support members 24*a* and 24*b* to the openings 21*a* and 21*b* of the speaker box 22 through a bayonet structure; thus, the process of the assembly of the speaker device 10 is facilitated.

In addition, the vibration of the acoustic radiation portion located at the front end of the speaker unit 20 can be effectively absorbed by the front cushion 30, so that the propagation of the vibration from the speaker unit 20 to the speaker box 22 can be more effectively suppressed.

Further, the first and second support members 24*a* and 24*b* can be attached to the speaker box 22 while the first and second support members 24*a* and 24*b* are temporarily assembled to the speaker unit 20; thus, the process of assembly of the speaker device 10 can be facilitated. Moreover, the claw portions 50 and 62 are not in contact with the speaker unit 20 when the first and second support members 24*a* and 24*b* are attached to the speaker box 22; thus, the propagation of the vibration from the speaker unit 20 to the speaker box 22 can be more effectively suppressed.

Further, the first and second support members 24*a* and 24*b* can be attached to the speaker box 22 through a so-called bayonet structure. Accordingly, the speaker unit 20 can be assembled without fastening a bolt, which facilitates the process of assembly of the speaker device 10.

Note that the present invention is not limited to the above-described embodiments and modifications, and various modifications or improvements can be made without departing from the scope of the matters in the claims.

For example, although the speaker device 10 including two speaker units 20 has been described above, this is not necessarily the case: the speaker device may include one, or three or more speaker units. When two or more speaker units are provided, speaker units of different types, sizes, or the like can be used.

REFERENCE SIGNS LIST

10 speaker device, 12 first speaker section, 14 second speaker section, 16 standing support, 20 speaker unit, 21 flange portion, 21*a*, 21*b* opening, 22 speaker box, 22*a* first box section, 22*b* second box section, 22*s* lower box section, 22*u* upper box section, 23*a*, 23*b* back wall, 24*a* first support member, 24*b* second support member, 25 front engagement projection, 26 diaphragm, 27 rear engagement projection, 28 driver, 29 engagement projection, 30 front cushion, 32 rear cushion, 40 front end portion, 41 internal space, 42 middle portion, 43 rear end portion, 44 rear end, 46 front engagement hook, 48 rear engagement hook, 50, 62 claw portion, 60 annular portion, 64 engagement hook

The invention claimed is:

1. A speaker device comprising:

a speaker unit that includes an acoustic radiation portion and a vibration portion which vibrates the acoustic radiation portion;

a speaker box that has an opening and is configured to form an enclosure of the speaker device by containing the speaker unit inserted from the opening;

a support member that is attached to the opening of the speaker box and pushes the speaker unit against a back wall in the speaker box, thereby supporting the speaker unit, wherein at least a part of the support member extends into the enclosure of the speaker device toward the back wall of the speaker box from a point at which the support member is attached to the opening of the speaker box;

a flexible front cushion compressed and contacted between the speaker unit and the support member, and that is configured to suppress propagation of a vibration from the speaker unit to the speaker box; and a flexible rear cushion compressed and contacted between the speaker unit and the back wall in the speaker box, and that is configured to suppress propagation of a vibration from the speaker unit to the speaker box wherein the speaker unit is pushed and supported by the support member and the back wall of the speaker box through the front cushion and the rear cushion;

the speaker unit and the support member do not contact each other and are connected to each other via the flexible front cushion; and the part of the support member extending into the enclosure engages the flexible front cushion within the enclosure of the speaker device to push the speaker unit against the back wall of the speaker box.

2. The speaker device according to claim 1, wherein the front cushion has such flexibility that the front cushion can be deformed more easily than the rear cushion.

3. The speaker device according to claim 2, wherein the front cushion is composed of elastic sponge, and the rear cushion is composed of felt.

4. A speaker device comprising:

a speaker unit that includes an acoustic radiation portion and a vibration portion which vibrates the acoustic radiation portion;

a speaker box that has an opening and is configured to form an enclosure of the speaker device by containing the speaker unit inserted from the opening;

a support member that is attached to the opening of the speaker box and pushes the speaker unit against a back wall in the speaker box, thereby supporting the speaker unit;

a flexible front cushion compressed and contacted between the speaker unit and the support member, and that is configured to suppress propagation of a vibration from the speaker unit to the speaker box; and a flexible rear cushion compressed and contacted between the speaker unit and the back wall in the speaker box, and that is configured to suppress propagation of a vibration from the speaker unit to the speaker box wherein the speaker unit is pushed and supported by the support member and the back wall of the speaker box through the front cushion and the rear cushion;

the speaker unit and the support member do not contact each other and are connected to each other via the flexible front cushion; and the support member includes multiple claw portions, the support member is configured to be temporarily assembled to the speaker unit when the multiple claw portions are engaged with a flange portion located at a front end of the speaker unit, and the claw portions are not in contact with the speaker unit when the support member temporarily assembled to the speaker unit is attached to the speaker box.

5. A speaker device comprising:

a speaker unit that includes an acoustic radiation portion and a vibration portion which vibrates the acoustic radiation portion;

a speaker box that has an opening and is configured to form an enclosure of the speaker device by containing the speaker unit inserted from the opening;

a support member that is attached to the opening of the speaker box and pushes the speaker unit against a back wall in the speaker box, thereby supporting the speaker unit;

a flexible front cushion compressed and contacted between the speaker unit and the support member, and that is configured to suppress propagation of a vibration from the speaker unit to the speaker box; and a flexible rear cushion compressed and contacted between the speaker unit and the back wall in the speaker box, and that is configured to suppress propagation of a vibration from the speaker unit to the speaker box wherein the speaker unit is pushed and supported by the support member and the back wall of the speaker box through the front cushion and the rear cushion;

the speaker unit and the support member do not contact each other and are connected to each other via the flexible front cushion; and the support member includes multiple engagement hooks, multiple engagement projections are formed on an inner surface of the speaker box at intervals along a circumferential direction, and the support member is attached to the speaker box when the multiple engagement hooks are inserted between the multiple engagement projections and the support member is relatively rotated with respect to the speaker box so that the engagement hooks are engaged with back surfaces of the engagement projections.

* * * * *